US008430705B1

(12) United States Patent
Sambandan et al.

(10) Patent No.: US 8,430,705 B1
(45) Date of Patent: Apr. 30, 2013

(54) SELF ASSEMBLY OF FIELD EMISSION TIPS BY CAPILLARY BRIDGE FORMATIONS

(75) Inventors: Sanjiv Sambandan, Bangalore (IN); John E. Northrup, Palo Alto, CA (US); Gregory L. Whiting, Menlo Park, CA (US); Robert A. Street, Palo Alto, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 23 days.

(21) Appl. No.: 13/291,593

(22) Filed: Nov. 8, 2011

(51) Int. Cl.
*H01J 1/62* (2006.01)
*H01J 63/04* (2006.01)
*H01J 9/00* (2006.01)

(52) U.S. Cl.
USPC ..... 445/50; 445/1; 445/49; 445/46; 313/495

(58) Field of Classification Search ..... None
See application file for complete search history.

(56) References Cited

U.S. PATENT DOCUMENTS

| | | | | |
|---|---|---|---|---|
| 5,921,838 | A | 7/1999 | Pack et al. | |
| 6,250,984 | B1 * | 6/2001 | Jin et al. | 445/51 |
| 6,628,052 | B2 | 9/2003 | Piehl | |
| 6,817,916 | B2 | 11/2004 | Piehl | |
| 7,192,327 | B2 * | 3/2007 | Takenaka et al. | 445/24 |
| 7,928,378 | B2 * | 4/2011 | Kimba et al. | 250/307 |
| 2002/0096551 | A1 * | 7/2002 | Reiber et al. | 228/4.5 |

* cited by examiner

*Primary Examiner* — Natalie Walford
(74) *Attorney, Agent, or Firm* — Fay Sharpe LLP

(57) ABSTRACT

A first side has a first surface on which is located a material, at least a portion of which is to be formed into at least one tip. A second side has a second surface which is heated. At least one of the first and second surfaces being moved so material located on the first surface comes into physical contact with the second surface. Then at least one of the first side and the second side are moved, wherein the physical contact between the material and the second surface is maintained, causing the material to stretch between the second surface and the first surface, generating at least one capillary bridge. Movement is continued until the physical contact between the material and the second surface is broken resulting in the formation of at least one sharp conductive tip.

20 Claims, 10 Drawing Sheets

| | | | | |
|---|---|---|---|---|
| X | 0.83 | - | - | mm |
| Y | 0.37 | - | - | mm |
| HT | - | - | - | um |
| DIST | | | - | mm |
| ANGLE | | | - | ° |

TITLE:

SELF ASSEMBLY OF FIELD EMISSION TIPS BY CAPILLARY BRIDGE FORMATIONS

BACKGROUND

The present application is directed to manufacturing processes, and more particularly to creating sharp pointed tips that are carried on substrates, including but not limited to field emission tips found on flexible substrates.

Presently sharp tip structures used, for example, as field emission devices are commonly "Spindt tip" type structures manufactured by the use of conventional lithographic techniques. More recently the use of carbon tubes has been suggested as a building block for the manufacture of such tips.

A 'Spindt tip' has a conical tip structure micro-fabricated on a substrate, which emits electrons by field emission. These tips have a relatively sharp apex, and are capable of creating a high electric field at a relatively low voltage, which results in the emission of significant amounts of current at relatively low gate voltages (e.g., less than 100 V). The use of lithographic manufacturing techniques means individual tips (i.e., emitters) allows for the tips to be packed close together, so that the average (or "macroscopic") current density obtained from a Spindt array can be as much as $2\times10^7$ A/m$^2$.

However, present manufacturing techniques are both time consuming and costly. It is therefore considered useful to develop a low cost manufacturing process capable of forming sharp tips for use in field emission displays, microscopy, and other field emission environments as well as for other no filed emission applications.

BRIEF DESCRIPTION

A system and method provides self-assembled sharp ended tips. A first side has a first surface on which is located a material, at least a portion of which is to be formed into at least one tip. A second side has a second surface which is heated to a predetermined temperature. At least one of the first and second surfaces being moved so that the material located on the first surface comes into physical contact with the second surface. Following such contact at least one of the first side and the second side are moved away from the other side, wherein the physical contact between the material located on the first surface and the second surface is maintained, causing the material to stretch between the second surface and the first surface, and thereby generating at least one capillary bridge formation. The movement is continued until the physical contact between the material located on the first surface and the second surface is broken resulting in the formation of the material into at least one sharp conductive tip.

DETAILED DESCRIPTION

Figure 1A:
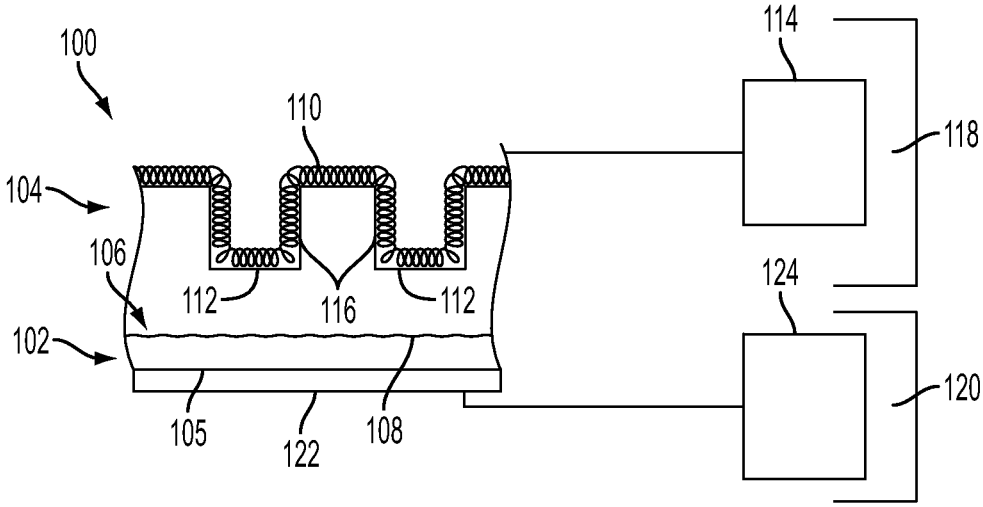
FIGS. 1A-1D depict a system and process for generating tips according to the present concepts.

Conductive sharp tips are of particular interest due to the high electric fields they generate when charged to a sufficient potential. The presence of high charge density and strong electric field help pull electrons off the tip easily leading to the creation of a field emission device. These field emission devices find applications in microscopy and field emission displays, among other areas. The following describes a method and system to create such sharp tips, which are identified by having surfaces with High Gaussian Curvatures.

Turning to FIGS. 1A-1D, illustrated is a system configuration 100 designed to perform a series of process step to produce sharp conductive tips, via a capillary bridge type formation. More particularly, as shown in FIG. 1, system configuration 100 includes a first side 102 and a second side 104. The first side includes a first surface 106, on which is located a material 108. In some embodiments, first side 102 includes a substrate 105, wherein the substrate is a rigid or flexible type substrate. The substrate and/or flexible substrate in some embodiments is a large area substrate or a continuously formed substrate.

The material may be any melt-able material, such as but not limited to metals, gels and glass. In some embodiments, such as in use with a flexible substrate, it is desirable to use a low melting point material which also has a high freezing point Examples of low melting high freezing point materials include but are not limited to ductile materials such as aluminum, copper, and brass, non-ductile materials such as cast iron, and rigid and non-rigid polymeric materials such as plastic and fiberglass-reinforced plastic that soften on exposure to fire and that are partially or completely consumed by fire.

The second side 104 includes a heating element 110 used to heat a second surface 112, wherein first surface 106 and second surface 112 are placed in a facing relationship to each other. Heating element 110 may, in one embodiment, be a coil heater powered by a heat generator 114. The second surface 112 is, in this embodiment, shown to have a plurality of spaced extending portions 116, wherein the extending portions extend toward material 108 located on first surface 106.

In certain embodiments second side 104, including second surface 112 and heating element 110 (and optionally heat generator 114) are configured as a unit to be moved by a movement mechanism 118. Optionally, first side 102 may also be configured as a unit capable of being moved by a move mechanism 120.

With continued attention to FIG. 1A, first side 102 may also optionally be provided with a heating element 122, for example supplied or attached to a backside of first side 102. This heating element 122 is then heated by a heat generator 124. The described heating element 122 and heat generator 124 are in certain embodiments included in the unit moved by movement mechanism 120. Movement mechanisms 118, 120 can be any known or future device able to move the surfaces (and/or units) in a controlled manner.

Figure 1B:
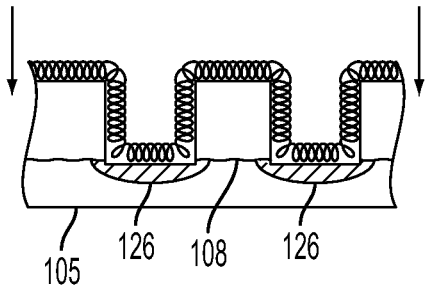

As further shown in FIG. 1A, extending portions 116 are aligned over specific areas of material 108. The extending portions 116 are heated via heating element 110 to a temperature above the melting point of material 108. Then, as shown in FIG. 1B second side 104 is brought down to allow contact between the heated extending portions 116 and material 108. Contacting material 108 with heated extending portions 116 results in material 108 melting in a melt area 126 corresponding to the location of the heated extending elements 116. Other portions of material 108 not located within this melt area 126 are maintained in a solid state.

Figure 1C:
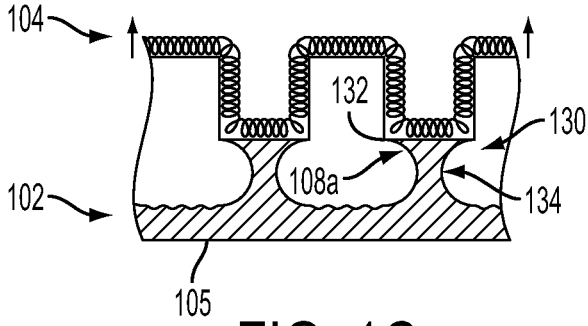

The extending elements 116 are maintained in the position of contact shown in FIG. 1B for a particular time. Then, as shown in FIG. 1C, second side 104 is brought at a predetermined speed away from first side 102. As extending portions are moved away from the first side, a portion of the melted material 108*a* remains adhered to second surface 112 generating capillary bridge formation 130.

Capillary bridge formation 130 continues to stretch and thin as second side 112 moves farther away from first side 102. During this time less and less heat is being transferred to the main body of the material 108 due to the removal of the heat source (i.e., heated extending elements 116) and the thinning nature of capillary bridge formation 130. Thus only the adhering portion of the material 108*a* is receiving heat, and more particularly that layer nearest an interface 132 between the adhered melted portion 108*a* and the surface of the heated extending portions 116. Therefore, by this process the pinch point 134 is moving back to a temperature where the material returns to a solid state (i.e., it freezes).

Figure 1D:
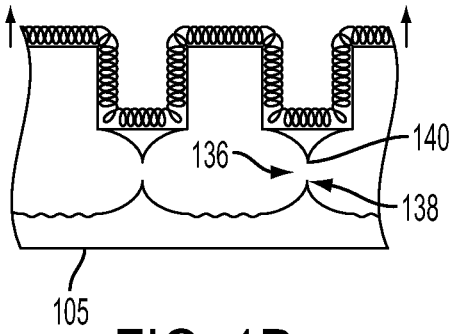

Then at the point as shown in FIG. 1D, as second side 104 is further drawn away from first side 102, capillary bridge formation 130 continues to be extended and narrowed resulting in a break 136 of the capillary bridge formation 130, where adhered material portion 108*a* is maintained on the extending portion 116 separated from the rest of material 108.

When the break occurs, since material 108 had not been receiving the heat and has been moving back to its solid state temperature, material 108 does not collapse as a liquid, but rather a point or tip 138 is formed by the freezing of material 108. It is also the adhered material portion 108*a* also has a tip type formation 140. This tip formation 140 is formed due to the heat decrease similar to those discussed above in connection with tip 138, but also due to gravitational forces when the second side is located physically above the first side. It is to be appreciated. Therefore, if it is desirable to employ the benefits of gravitation with regard to tips being formed on a substrate (e.g., side one). The physical relationship between the first side and second side may be reversed where the first side (having the substrate) is located physically above the second side.

As mentioned above, extending portions 116 are brought into physical contact with material 108 for a period of time (see FIG. 1B) prior to being moved away. For example, this time may be a predetermined clock time, i.e., after X seconds the movement away begins. Alternatively, system 100 may include a temperature sensor that measures the temperature of the material, wherein once a predetermined temperature is sensed, a signal is provided to movement mechanism 118 to move second side 104 away from first side 102.

The foregoing method/process discussed the heating of first surface 106 and movement of second side 104. However, as shown in FIG. 1A first side 102 may be formed to include heating element 122 and may be moved by moving mechanism 120. Therefore, in alternative process embodiments, material 108 may be preheated to just below its melting temperature prior to engagement with the heated extending portions 116 of second surface 112. Additionally, in some embodiments, it may be useful to maintain second side 104 stationary and move first side 102 to engagement by use of moving mechanism 120. Still optionally, in some situations it may be beneficial to move both first side 102 and second side 104 for engagement.

It is noted that while for clarity of the description FIGS. 1B-1D do not show all the parts detailed in FIG. 1A, it is understood the components of FIG. 1A are included in the concepts of FIGS. 1B-1D.

In forming tips, control parameters will vary depending on the particular material used and the desired tip configuration (e.g., the desired tip diameter, height, sharpness, etc.). Examples of such control parameters include but are not necessarily limited to the temperature of the heated extending elements (and optionally the temperature of the first side), as well as the speed at which surface engagement and disengagement occurs. Further, once the tips are formed a further step would be to deposit, by a known deposition process, a low work function conductive material over the sharp tips formed of another material.

Figure 2:
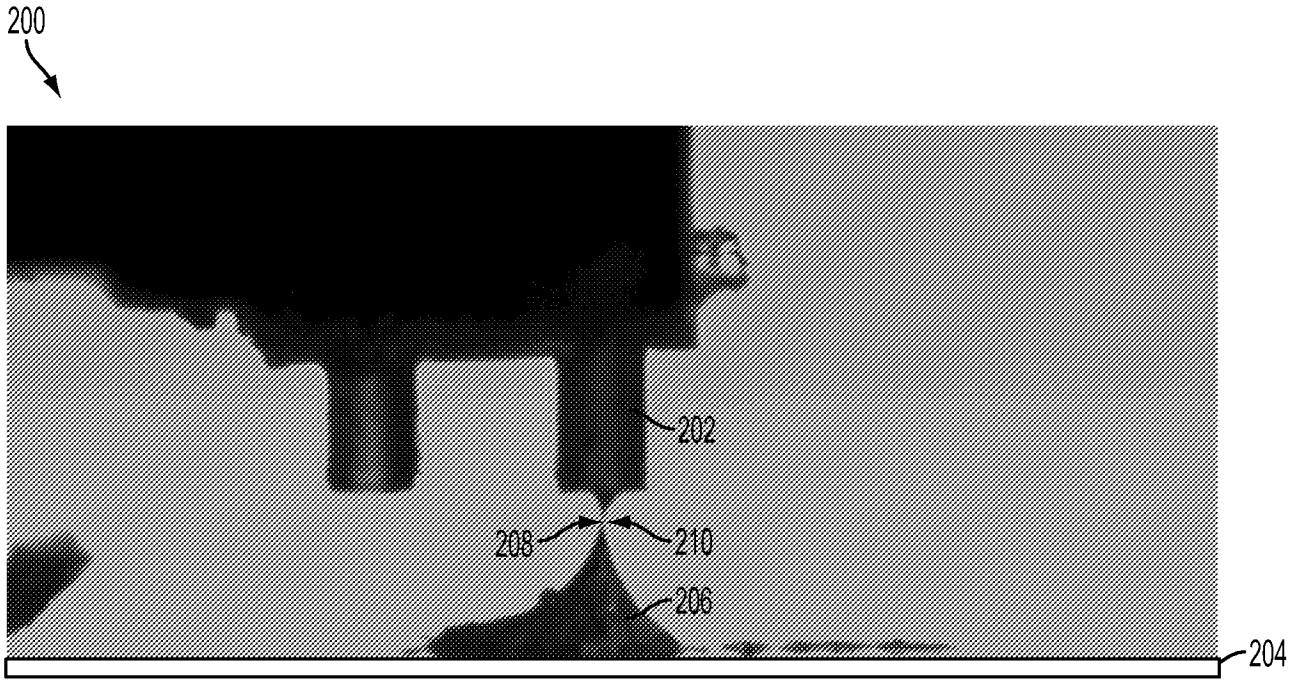
FIG. 2 illustrates a side view of a tips generating system.

Turning to FIG. 2, depicted is a side view showing a tip forming system 200 at a stage in the process immediately before a tip is fully formed. Particularly, the extending portion (or called here a PDMS stamp) 202 has pulled away from first side 204 such that melted material 206 associated with the first side 204 and the melted material 208 in contact with the extending portion 204 have formed capillary bridge 210, which is thinned and about to become broken.

Figure 3:
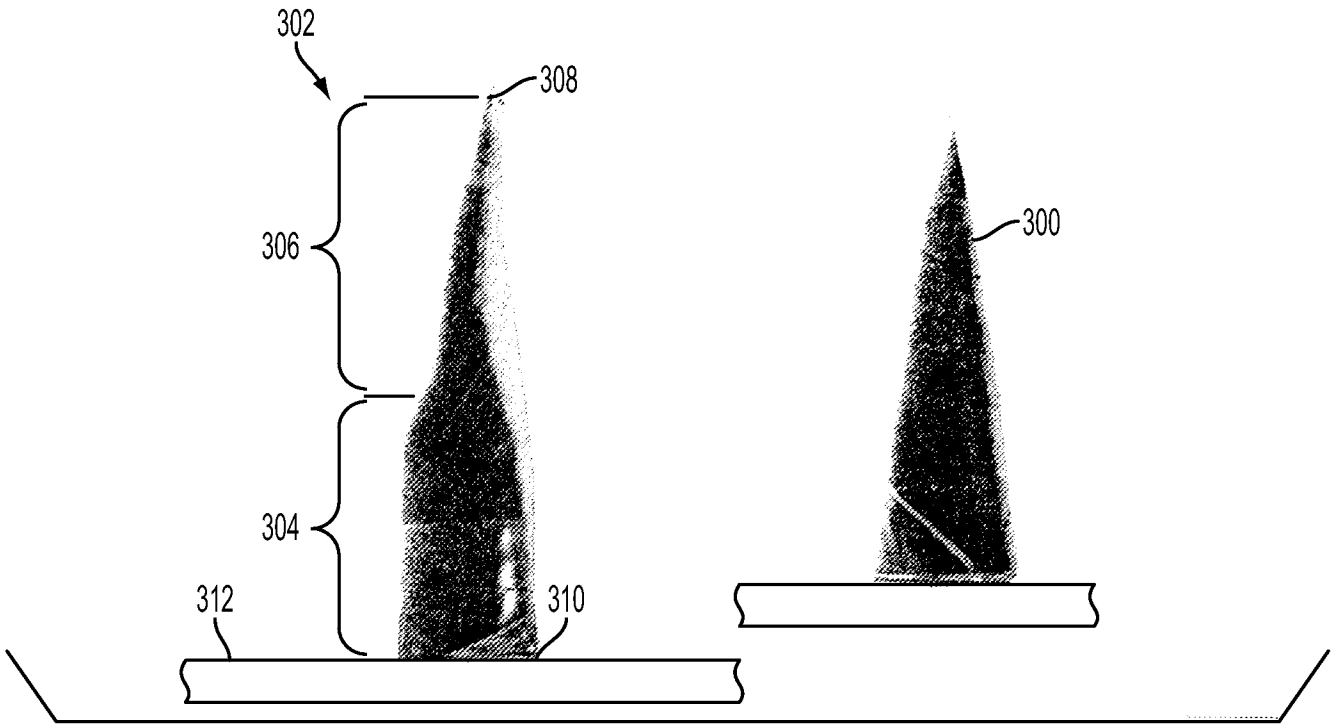
FIG. 3 illustrates views of a tip formed according to existing technologies and a tip formed according to the present concepts.

As previously mentioned, other processes have been used to form conductive tips. FIG. 3 illustrates a conductive tip 300 formed by such a known process, such as one employing lithographic techniques. It can be seen that this tip has a cone type appearance. On the other hand, the capillary bridge tip 302 formed by the present process has a distinct appearance due to the capillary bridge formation technique employed herein. Particularly, tip 302 includes a base portion 304, which at least at its base is approximately more than twice as large as a capillary bridge portion 306, which extends therefrom. This capillary bridge portion 306 ends in an extended sharp end tip portion 308. It is understood a bottom end 310 of base 304 is integrated into a substrate 312, such as a flexible substrate. The capillary bridge formation developed by the present process therefore has a unique structure (exponential surface profile) and non-zero Gaussian Curvature, as compared to existing conductive tips.

Figure 4:
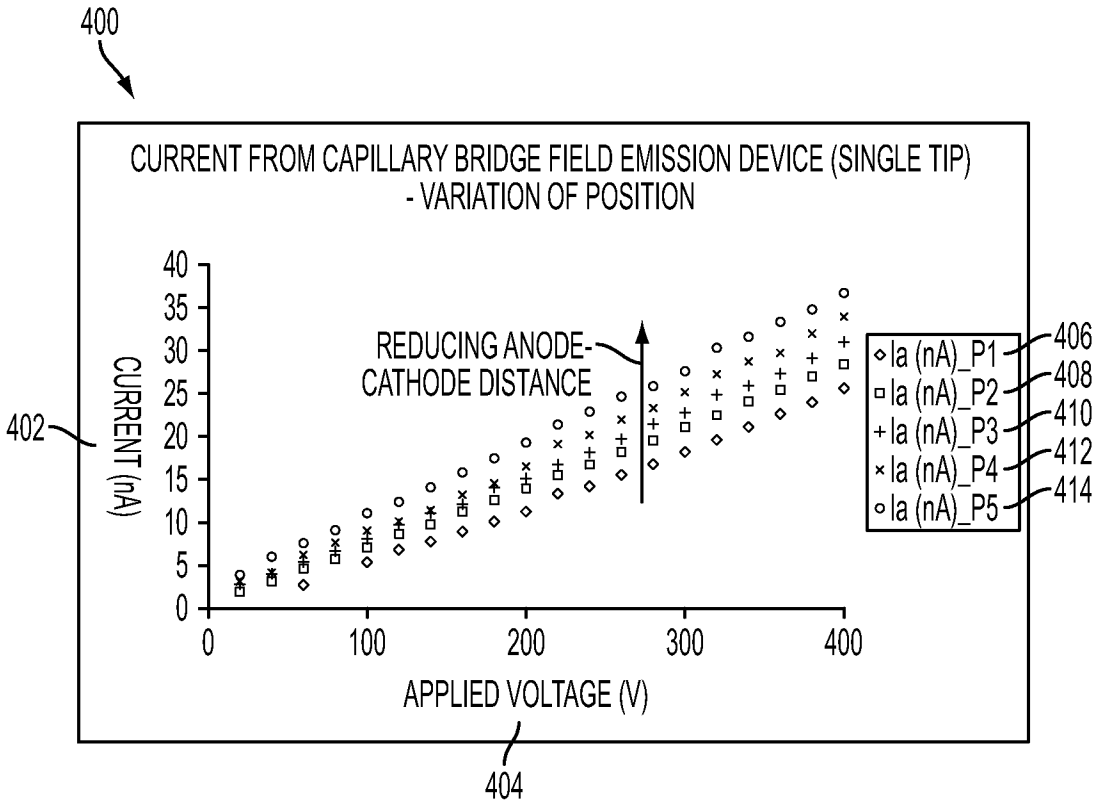
FIG. 4 illustrates a chart showing current flow from a tip manufactured according to the present application.

Turning to FIG. 4, depicted is a chart 400 comparing current output 402 as a function of an applied voltage 404, wherein the current measurements are taken at various positions of a capillary bridge field emission device (i.e. tip) constructed according to the present application. In particular, the testing recorded current flow at various applied voltages when a tip (e.g., a cathode) is position at various distances from a flat metal plate (e.g., and anode). As can be seen, a consistent increase in current flow occurred as the applied voltage was increased and as the anode, cathode distance was reduced (for example, going from P1 (the farthest distance) to P5 (the shortest distance) 406-414. The dependence of current on the anode to cathode distance is indicative of tunneling and the influence of the single sharp tip at these voltages.

Figure 5:
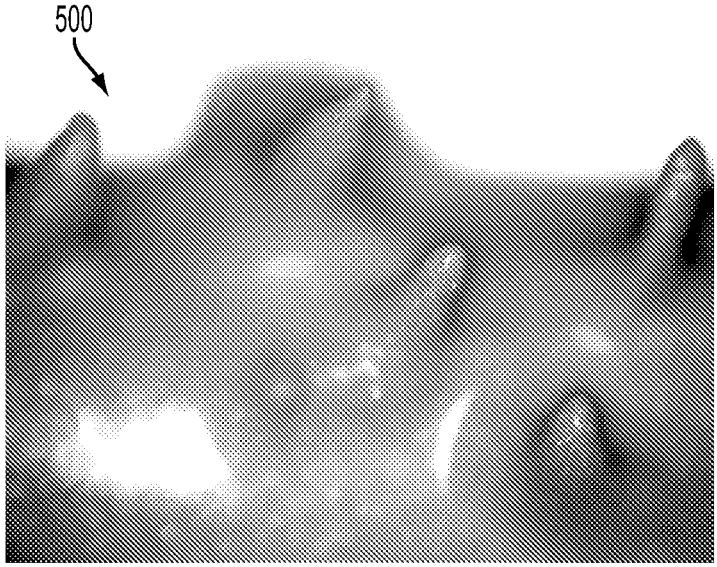
FIGS. 5 and 6 illustrate images of tips formed according to the present application.
Figure 6:
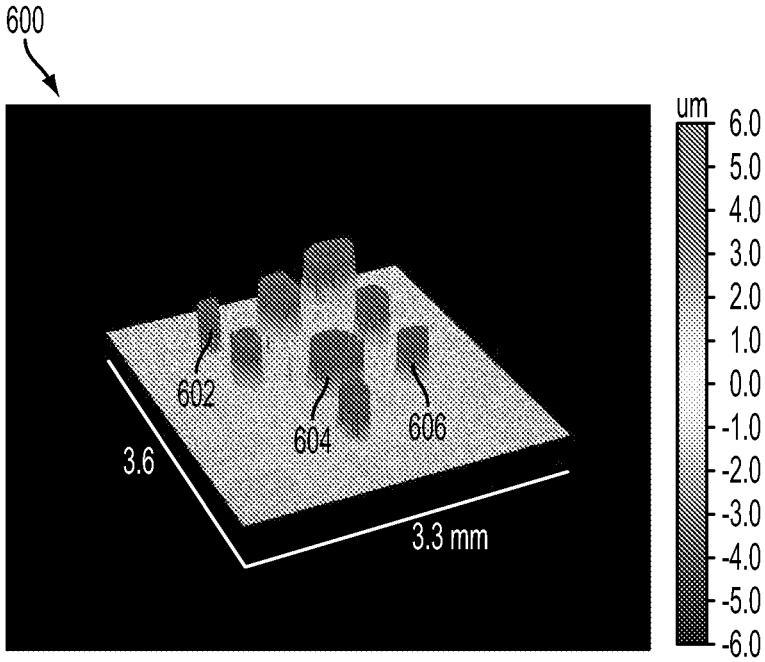

It is to be appreciated that, while the foregoing discussion maybe interpreted to be showing the extending portions aligned and of the same shapes and dimensions, the tips may be formed in any of a number of arrangements. This is illustrated by the images shown in FIGS. 5 and 6. Where in FIG. 5 tips 500 can be seen in a non-aligned arrangement on surface 502 and the image shown in FIG. 6 shows not only that tips may be formed in a variety of patterns but also that the tips 602, 604, 606, may be formed of varying dimensions as well as shapes.

Figure 7:
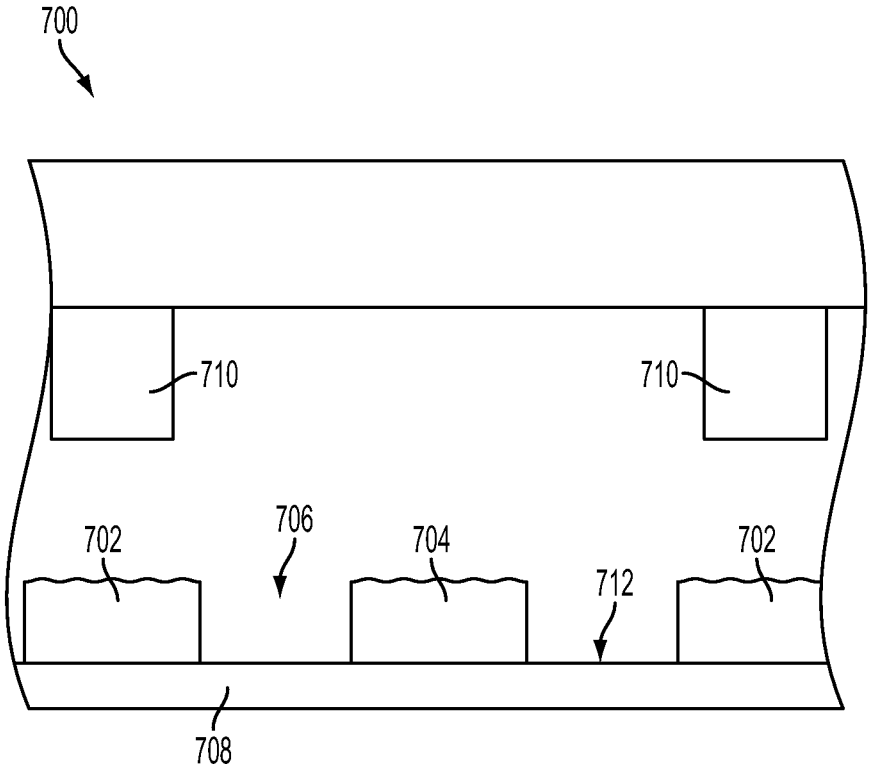
FIG. 7 illustrates an alternative implementation of the concepts of the present application.

Turning to FIG. 7, illustrated is a side view of a system 700, according to the present concepts. In this embodiment the material is comprised of a first material 702, and a second material 704 on a first surface 706 of a first side 708. The first material 704 and the second material 706 are materials having different characteristics including having different melting temperatures and different atomic and/or chemical structures. For example, material 702 may be a metal, where material 704 may be a ceramic. Extending portions 710 are shown over material portions 702 prior to formation of tips at these locations. It is also shown the surface 706 may have portions with no material 712. Therefore the materials 702 and 704 may be adjacent each other or separated from each other. From FIG. 7 it is understood that the material being used to form conductive tips can be applied to first surface 706 on only selected sections of the substrate.

Figure 8:
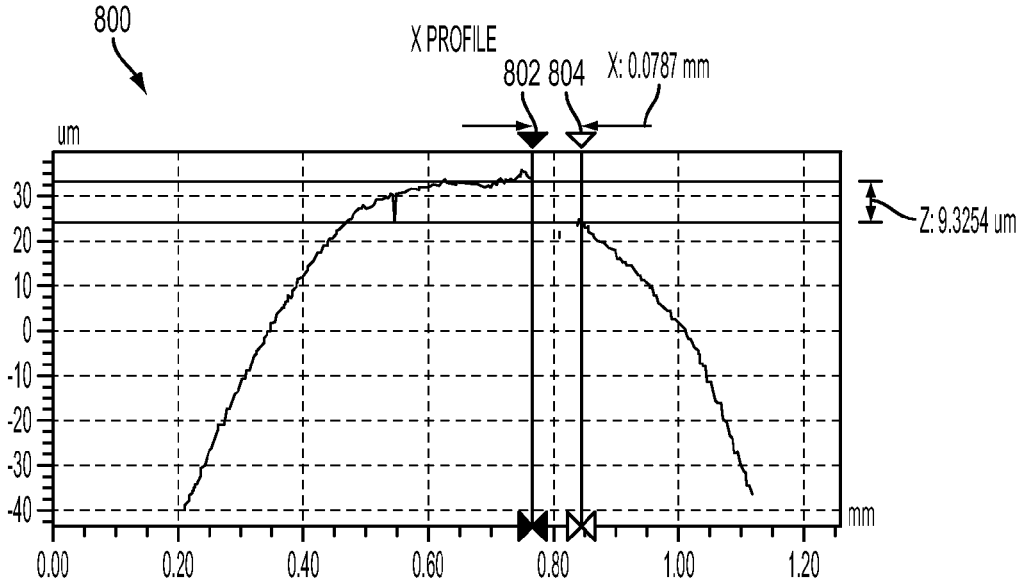
FIGS. 8 and 9 illustrate respective X and Y views of a tip.
Figure 9:
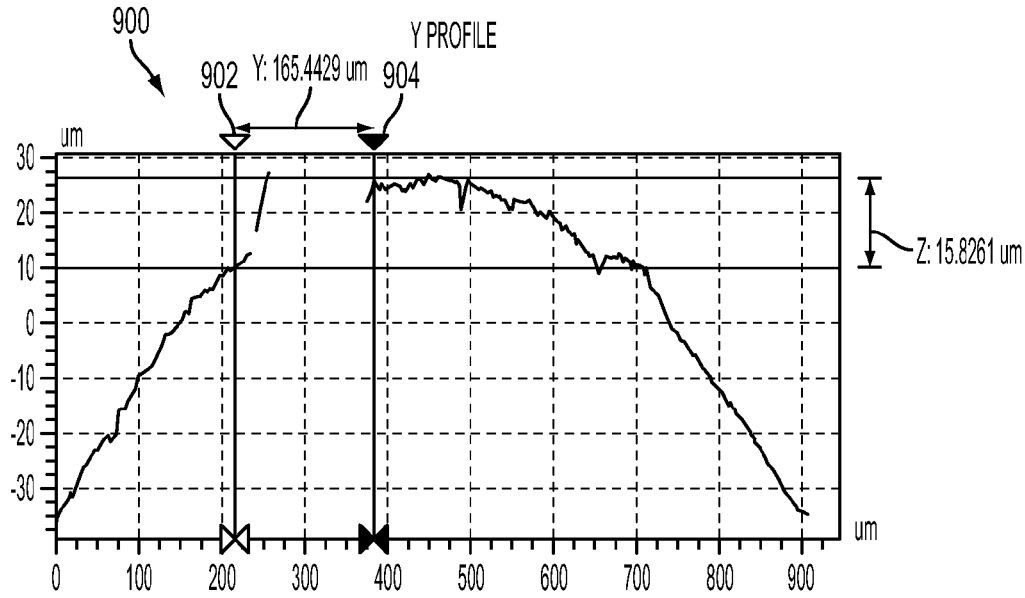

FIG. 8 shows an X profile 800 where the area located between triangles 802, 804 define an upper limit as to the width of the tip. FIG. 9 illustrates a Y profile 900, where the width of the tip is shown between triangles 902, 904. FIGS. 8 and 9 relate to tips made of gallium.

Figures 10, 11:
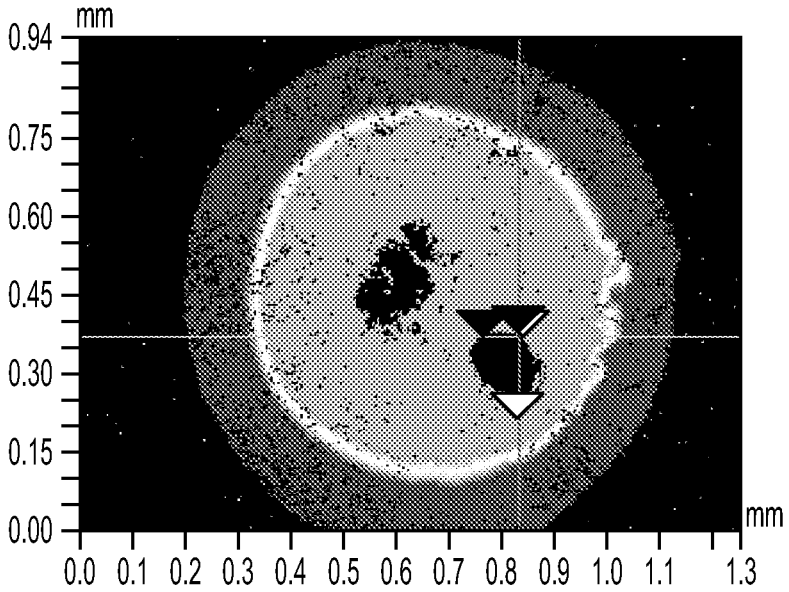
FIG. 10 is a top optical view of a tip.
FIG. 11 is a chart showing a dimension of a tip from the X and Y views.

FIG. 10 shows an optical view of the a tip, and FIG. 11 shows X to be 0.83 mm and Y to be 0.37 mm.

Figure 12:
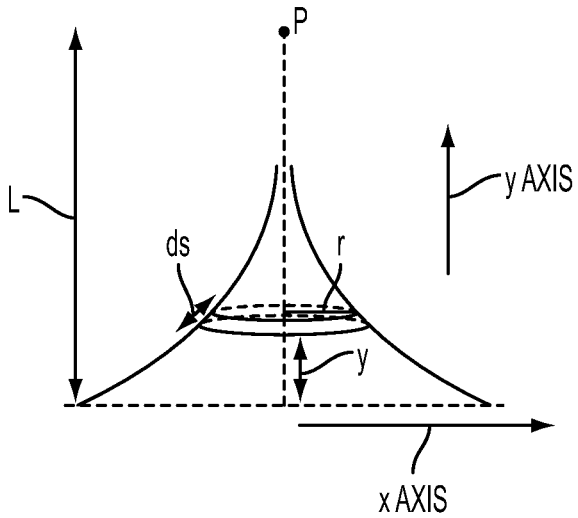
FIGS. 12-14 show views of a tip used in an estimation of the electrical field of a capillary bridge tip for a field emission device.

The following discussion and FIGS. 12-14 describe the steps to obtain an estimation of the electric field for a capillary bridge field emission device which may be built according to the concepts of the present application, as derived by steps I-III below:

I. Geometry of the Bridge (See FIG. 12):

$$\text{Laplace-Young: } \Delta\rho = -\gamma\frac{\delta^2 y}{\delta y^2 r} - \frac{\gamma\delta^{2y}}{\delta r^2} = \rho g y = )y = y_o e^{-\propto r}$$

$$\propto = \sqrt{\rho g/\delta}$$

δ: Surface Tension

ρ: Density of Melt g: Gravitational Acceleration

II. Exact Vertical Electric Field (at Point ρ)

Figure 13:
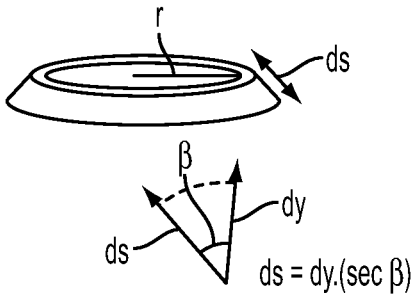

(See Electric Field of hoop shown in FIG. 13).

$$\frac{\sigma}{2\in}{}_{\circ}\frac{(L-y)\cdot r\cdot ds}{((L-y)^2+y^2)^{\frac{3}{2}}}$$

σ: (Assumed) constant charge density/unit area for the hoop. However, for a field emission device (FED): σ=function of curvature.

$$\sigma = \sigma_o k^{\frac{1}{4}},\ k = \text{Gaussian curvature.}$$

Estimation of Gaussian Curvature:

$$k^{\frac{1}{4}},\ = (k_1 k_2)^{\frac{1}{4}} = \left(\frac{\delta^{2y}}{\delta r^2}\cdot\frac{1}{r\gamma}\right)^{\frac{1}{4}} = \sqrt{\propto}\,\frac{y^{\frac{1}{4}}}{\gamma r}$$

Exact Electric Field at ρ and along y-axis:

$$\xi_{\rho\uparrow} = \int_{y=0}^{y=y_o}\frac{\sigma_o}{2\in_o}\cdot\frac{(L-y)\cdot r\uparrow\cdot\sqrt{\propto}\,(y/r)^{\frac{1}{4}}}{(L-y)^2+y^2)^2}\cdot\left[1+\frac{1}{\propto^2 y^2}\right]^{\frac{1}{2}}\cdot dy$$

Figure 14:
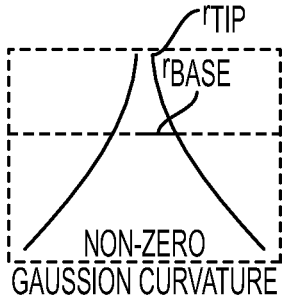

(NOTE: ds=dy, see β in FIG. 14)

III. Approximation:

Close to the tip: k blows up and can be approximated (consider only mean curvature).

$$\xi_{\rho\uparrow} \cong -\frac{\sigma_o}{4\in_o}\ln\frac{r_{tip}}{r}$$

$$\text{Potential}=k\ \ln(r_{tip})\hat{}\,r_{tip}/(r_{base}+(-r_{tip}+r_{base})k$$

The foregoing described system and process is applicable to rigid substrates, as well as flexible substrates. The process of forming the tips may be a stamping type process where a substrate is brought to and aligned with extending portions. Then appropriately calibrated (taking into account the material being processed and the appropriate parameters needed for that material) engagement and dis-engagement steps are performed between the first side and the second side to form tips. Thereafter, the substrate is removed. However, alternatively, the present system and process may be employed in a continuous conveyor type system where a continuous substrate strip is moved underneath the extending portions at the appropriate location, for tip formation operations.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

What is claimed is:

1. A method for self-assembly of field emission tips comprising:

providing a first side having a first surface on which is located in material to be formed into at least one field emission tip;

providing a second side having a second surface;

heating the second surface of the second side, to a predetermined temperature;

moving at least one of the first side and a second side, wherein physical contact is made between the material located on the first surface and the second surface;

maintaining the physical contact between the material on the first side and the second surface of the second side for an amount of time;

moving, after the amount of time, at least one of the first side and the second side away from the other side, wherein the physical contact between the material located on the first surface and the second surface is maintained causing the material to stretch between the second surface of the second side and the first side, generating at least one capillary bridge formation; and continuing to move at least one of the first side and the second side away from the other side, until the physical contact between the material located on the first surface and the second surface is broken, causing the formation of the material into a conductive tip.

2. The method according to claim 1 wherein the second surface is heated to a temperature above the melting point temperature of the material.

3. The method according to claim 1 wherein the second surface is further formed to have a plurality of spaced extending portions which extend away from the second side toward the material on the first surface, wherein the extending portions are configured to be placed into contact with the material.

4. The method according to claim 1 wherein the first side is a large area flexible substrate.

5. The method according to claim 1 further including depositing a low work function conductive material over the conductive tip, wherein the low work function conductive material is formed of a material different from the material of the conductive tip.

6. The method according to claim 1 wherein the conductive tip is a field emission tip.

7. The method according to claim 6 wherein the field emission tip is within an array of field emission tips formed via a capillary bridge formation.

8. The method according to claim 7 wherein the capillary bridge formation has an exponential surface profile and a non-zero Gaussian Curvature.

9. The method according to claim 1 wherein the first side includes a first material and a second material, the first material and the second material being spaced from each other and/or adjacent to each other.

10. The method according to claim 9 wherein the first material and the second material are materials having different characteristics including having different melting temperatures.

11. The method according to claim 2 wherein the temperature of the second surface is between 0.5 degrees and 5 degrees above the melting temperature of the material.

12. The method according to claim 1 wherein the first surface is heated to a temperature just below the melting temperature of the material.

13. The method according to claim 1, wherein the at least one tip is configured to be formed on soft conductive materials wherein the at least one tip degrades with time in a predictable manner and wherein the at least one tip is configured to be set up on any instrument or object whose lifetime needs to be measured, and wherein by monitoring current decay through the at least one tip the lifetime of the instrument or object is determined.

14. A system for self-assembly of field emission tips comprising:

a first side having a first surface on which is located in material to be formed into at least one field emission tip;

a second side having a second surface;

a heat generating arrangement configured to heat the second surface of the second side, to a predetermined temperature;

a moving mechanism arrangement configured to move at least one of the first side and a second side, wherein the movement results in physical contact between the material located on the first surface and the second surface, for an amount of time, and further configured to move at least one of the first side and the second side away from the other side, wherein the physical contact between the material located on the first surface and the second surface is maintained causing the material to stretch between the second surface of the second side and the first side, generating at least one capillary bridge formation; and a conductive tip formed on at least the first surface of the first side, following a break in the capillary bridge has occurred.

15. The system according to claim 14 wherein the heating generating arrangement is configured to heat the second surface to a temperature above the melting point temperature of the material.

16. The system according to claim 14 wherein the second surface is further formed to have a plurality of spaced extending portions which extend away from the second side toward the material on the first surface, wherein the extending portions are configured to be placed into contact with the material.

17. The system according to claim 14 wherein the first side is a large area flexible substrate.

18. The system according to claim 14 further including a low work function conductive material deposited over the conductive tip, wherein the low work function conductive material is a material different from the material of the conductive tip.

19. The system according to claim 14 wherein the conductive tip is a field emission tip.

20. The system according to claim 14 wherein the capillary bridge formation has an exponential surface profile and a non-zero Gaussian Curvature.

* * * * *